US005674112A

United States Patent [19]

Steinwender

[11] Patent Number: 5,674,112

[45] Date of Patent: Oct. 7, 1997

[54] PROCESS AND APPARATUS FOR CENTERLESS SUPERFINISHING OF ROLLERS

[75] Inventor: Horst Steinwender, Wuppertal, Germany

[73] Assignee: Supfina Maschinenfabrik Hentzen GmbH & Co. KG, Remscheid, Germany

[21] Appl. No.: 504,845

[22] Filed: Jul. 20, 1995

[30] Foreign Application Priority Data

Jul. 20, 1994 [DE] Germany ..... 44 25 561.6

[51] Int. Cl.[6] ..... B24B 5/37

[52] U.S. Cl. ..... 451/49; 451/172; 451/57

[58] Field of Search ..... 451/49, 172, 164, 451/163, 162, 131, 58, 57, 338

[56] References Cited

U.S. PATENT DOCUMENTS

| | | | |
|---|---|---|---|
| 1,886,579 | 11/1932 | Pew | 451/49 |
| 2,327,022 | 8/1943 | Dall et al. | 451/164 |
| 4,558,537 | 12/1985 | MacLeod et al. | 451/172 |

FOREIGN PATENT DOCUMENTS

| | | | |
|---|---|---|---|
| 2436474 | 3/1975 | Germany . | |
| 3225977A1 | 1/1984 | Germany . | |
| 3707335A1 | 9/1988 | Germany . | |
| 3707334A1 | 9/1988 | Germany . | |
| 671998 | 7/1979 | U.S.S.R. | 451/163 |

*Primary Examiner*—Robert A. Rose

*Attorney, Agent, or Firm*—Jones, Tullar & Cooper, P.C.

[57] ABSTRACT

In a process and an apparatus for centerless superfinishing of rollers with arbitrarily curved jacket faces by means of an oscillatingly driven honing stone, the rollers are transported in the continuous process and the honing stone moves together with the rollers at the same speed or at superimposed speeds. The rollers rotate relative to their associated honing stone as a result of being transported causing machining to occur.

45 Claims, 3 Drawing Sheets

Fig. 3a
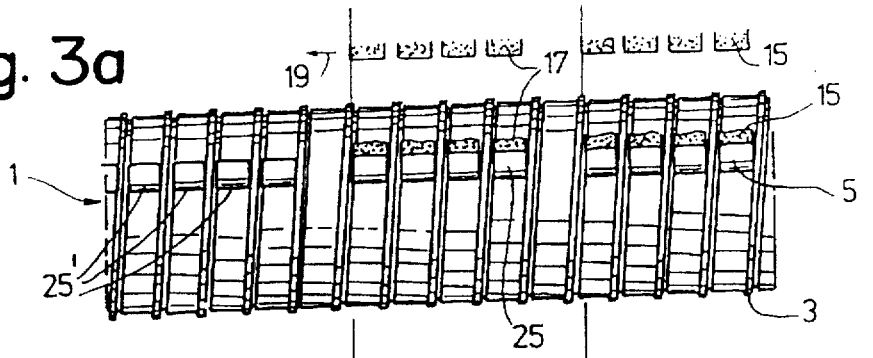
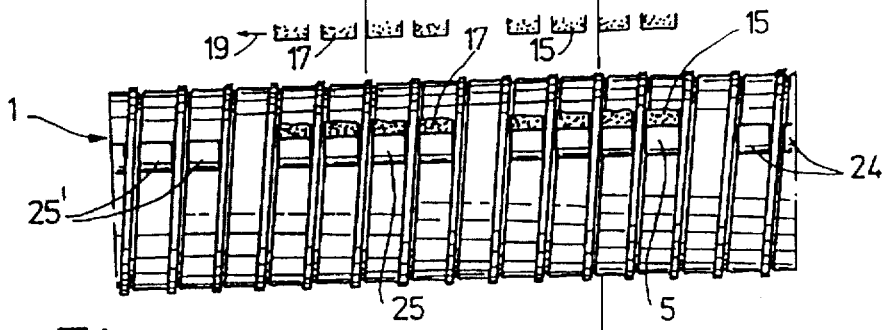
Fig. 3b
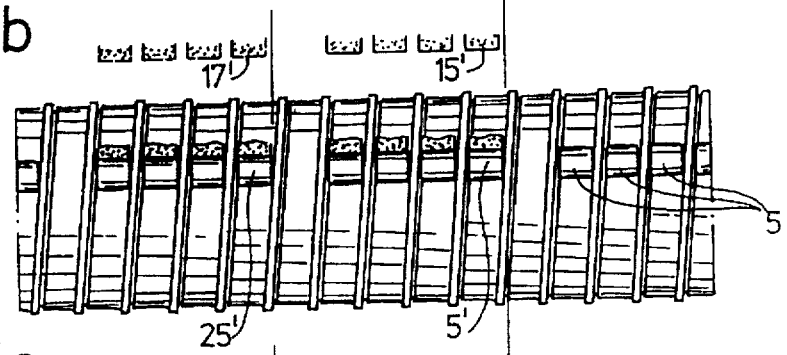
Fig. 3c
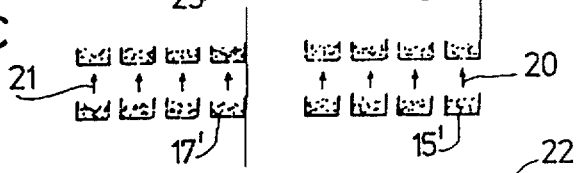
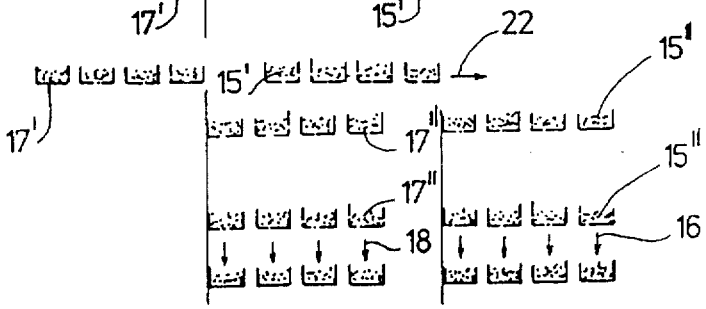
Fig. 3d
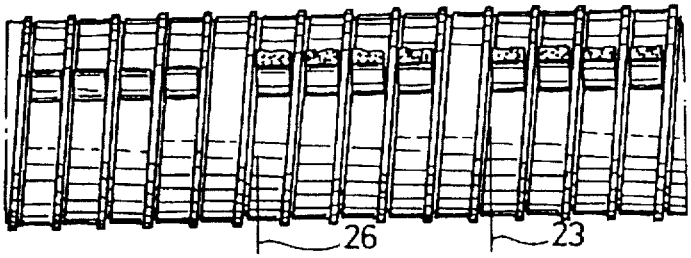
Fig. 3e

PROCESS AND APPARATUS FOR CENTERLESS SUPERFINISHING OF ROLLERS

FIELD OF THE INVENTION

The present invention relates to a process and an apparatus for centerless short-stroke honing or superfinishing of rollers with an arbitrarily cured jacket face, which are machined by means of an oscillating honing stone.

BACKGROUND OF THE INVENTION

Apparatuses for centerless short-stroke honing or superfinishing are known in which the rollers to be machined rest upon two transport cylinders and are supported by these cylinders and transported by the apparatus in the axial direction of the rollers. The rollers are machined by honing stones. Machines of this kind are also called superfinishing machines. The honing stones carry out a short-stroke oscillating motion during the machining of the rollers. The rotational motion of each roller around its longitudinal axis and the feed motion of the roller by means of the apparatus is superimposed on this oscillating motion. A machining process of this type is also called a continuous process. With this process, however, only cylindrical rollers can be machined, i.e. rollers with a cylindrical jacket face. These rollers run through in the direction of their longitudinal axes, under a plurality of honing stones. Care must be taken that the individual rollers, without intermediary spaces between one another, be passed underneath the honing stones. With this process, the rollers an the edge region are machined more intensely than in the middle region of the jacket face, so that as a rule, they have a slightly smaller radius in the edge region, even if only slightly, i.e. they have a crowned surface.

Besides continuous machines of this type, apparatuses are also known that work according to the plunge-cutting process. In these machines, each individual roller is machined by a finishing stone; apart from the oscillating motion of the finishing stone, no relative movements or only slight ones occur between the stone and the roller in the axial direction of the roller. With the plunge-cutting process, both cylindrical jacket faces and crowned, concave, and otherwise-embodied jacket faces can be machined. It is viewed as disadvantageous, though, that long machining times arise due to the separate loading and unloading of the individual rollers so that plunge-cutting processes of this kind are not used as a rule for a rational machining on a large scale.

OBJECT AND SUMMARY OF THE INVENTION

An object of the present invention is to make available a process and an apparatus for centerless superfinishing of rollers, with which on the one hand, short machining times can be produced and on the other hand, in addition to jacket faces which are cylindrical, jacket faces which diverge from the cylinder shape can also be machined.

This object is attained with a process according to the present invention by the fact that the roller is transported in the continuous process and that the honing stone moves with the roller during its machining.

In the process according to the present invention, therefore, the rollers pass through the apparatus as in the continuous process, by means of which a continuous operation, and consequently automation, is guaranteed. In contrast to the conventional continuous process, in which the honing stones are stationary apart from their oscillating motion, in the process according to the present invention, they move with the individual rollers over a certain distance through the machining apparatus. There is thus a special honing stone associated with each roller. This essentially corresponds to the plunge-cutting process, in which a honing stone is likewise associated with a roller. In this manner, the advantage is achieved, that the roller can have a jacket shape which diverges from the cylinder shape, since the workpiece does not run through under the tool. The process according to the present invention, therefore, has the advantage that a continuous process, and consequently an automatic process, is nevertheless possible with rollers, which diverge from the cylinder shape. By individually machining each roller in the continuous process, the tolerances of the roller diameter of the unmachined roller can be essentially higher compared with the continuous billet process, in which the tolerance limit is approximately 4 μm. With the process according to the present invention, it can be in the 1/10 mm region.

Advantageously, in the process according to the present invention, different methods can be carried out with the rollers than in the prior art. Normally, the rollers should undergo at least 180 revolutions under the honing stone. By means of the present invention, it is now possible to use thinner or shorter rollers. In the process according to the present invention, the number of roller revolutions is reduced; by means of the improved process technology, a work result is achieved, which is equal or improved.

In preferred embodiments, the honing stone is moved in a linear oscillating motion, or in an oscillating motion which swings in pendulum fashion, or in an oscillating motion which combines linear and pendulum motion. In this manner, both cylindrical and crowned, concave, and convex rollers can be machined; the jacket face can also be logarithmically curved. Naturally, conically embodied jacket faces can also be machined.

In an exemplary embodiment, it is provided that the honing stone oscillates symmetrically to the roller's jacket line, which is to be machined. This is especially the case with cylindrical and conical rollers. However, the rotational axis of the roller can also be disposed parallel to the axis of oscillation or in the plane perpendicular to the face end machining. This is especially the case whenever the honing stone oscillates around an axis perpendicular to the axis of the roller; the axis of oscillation can be disposed above or below the axis of the roller. In special cases, the axis of oscillation of the honing stone can also coincide with the axis of the roller. Particularly with conical rollers, the axis of oscillation of the honing stone is slanted in comparison to the axis of the roller.

In order to increase machining capacity, up to twenty honing stones simultaneously engage a corresponding number of rollers in a work cycle. Thus for example 5, 10, or 20 rollers are simultaneously machined by 5, 10, or 20 honing stones. These honing stones travel as a group with the rollers to be machined so that the throughput is correspondingly higher.

At the beginning of the machining process, these honing stones are placed upon the rollers and travel with these over the machining path during the entire machining process. After the end of the machining process, the honing stones are lifted up from the rollers and quickly returned to their initial position. There, they are placed behind the rollers which were last machined, and upon the next group of rollers to be machined and carry out the next machining pass. During the return trip, for example, the machining face of the honing stone can be treated with a flushing agent, so that any material removed by machining yet still adhering is indeed taken away. This prevents clogging; otherwise, eventually no further removal of material could be accomplished. This clogging can certainly occur in conventional continuous processes, since in such processes the honing stones are constantly engaged.

In a preferred exemplary embodiment, the roller is machined in the one- or multi-step process, which in particular can have up to twenty steps. In a simple example, the roller is pre-machined for example in a first machining step with pre-finishing stones and in the second step is machined to a final state with final finishing stones. In these multi-step processes, the honing stones that follow are then placed upon the respective rollers when the preceding honing stones are lifted up. The individual honing stones of the individual steps can be placed synchronously, i.e. in the same phase, upon the rollers and lifted up again from them.

The above mentioned object is attained according to the present invention with an apparatus in which the honing stone is connected to the device for transporting the rollers in such a way that the honing stone is transported together with the rollers and machines one roller per pass.

Accordingly, the honing stone(s) are coupled to the transport system for the roller(s) and run through the apparatus at the same speed so that they essentially execute no movement relative to the rollers. In any event, it is guaranteed that during the passage of the individual rollers through the machine, a designated honing stone is associated with each roller.

In some embodiments it can be provided that the infeed of the honing stone can be altered, in particular in accordance with the infeed of the roller. The honing stone can travel on the jacket face of the roller; the honing stone still machines only one individual roller during a work cycle. During passage through the machine, the honing stone can be moved slightly slower or faster than the roller so that it travels slightly on the roller.

In an exemplary embodiment, it is provided that the infeed of the honing stone and/or the infeed of the roller can be altered during machining. The infeed can, for example, be rapid at the beginning of machining and get slower toward the end or can be varied via the position of the individual roller, by means of which the shape of the roller can be influenced.

Preferably the honing stone(s) are individually disposed via the roller(s). In this manner, the individual honing stone by means of its machining surface can precisely accommodate the workpiece surface.

In a preferred exemplary embodiment, honing stones with the same specifications are combined into groups. Thus for example the first group can contain pre-finishing stones, which is followed by a second group with final finishing stones. In this manner, a plurality of rollers can be machined simultaneously by stones of the first group and then next by the stones of the other groups.

In a preferred exemplary embodiment, the device for transporting the rollers has transport rollers and is provided with a transport worm, whose shape corresponds to the jacket shape of the roller. If for example barrel-shaped rollers need to be machined, then the transport worm has a concave shape. In an exemplary embodiment, it is provided that the transport worm is adjoined by a transport shoulder. This transport shoulder executes or promotes the transport of rollers on the transport rollers and holds them in the position predetermined for them on the transport worm.

In some embodiments of the present invention, the transport worm can have multiple threads. Furthermore, the transport rollers can be aligned to each other.

In some embodiments of the invention, the rollers can have linear and/or tangential contact with the transport rollers.

Preferably the honing stone has a contact face which corresponds to the jacket face of the roller. The honing stone can have a rectangular, H-shaped, or square basic form. Then the corresponding contact face, which rests upon the workpiece, is formed on this basic form.

Optimal work results can be achieved by the fact that for each roller a separate receptacle and a separate pendulum device is provided for the corresponding honing stone.

Further advantages, characteristics, and details ensue from the description below, in which particularly preferred embodiments are shown in detail with respect to the drawing.

BRIEF DESCRIPTION OF THE DRAWINGS

FIGS. 3*a*–3*e* show a course of the process of the two-step process according to FIG. 2, showing individual progressive steps of the process.

DESCRIPTION OF THE PREFERRED EMBODIMENTS

Figure 1:
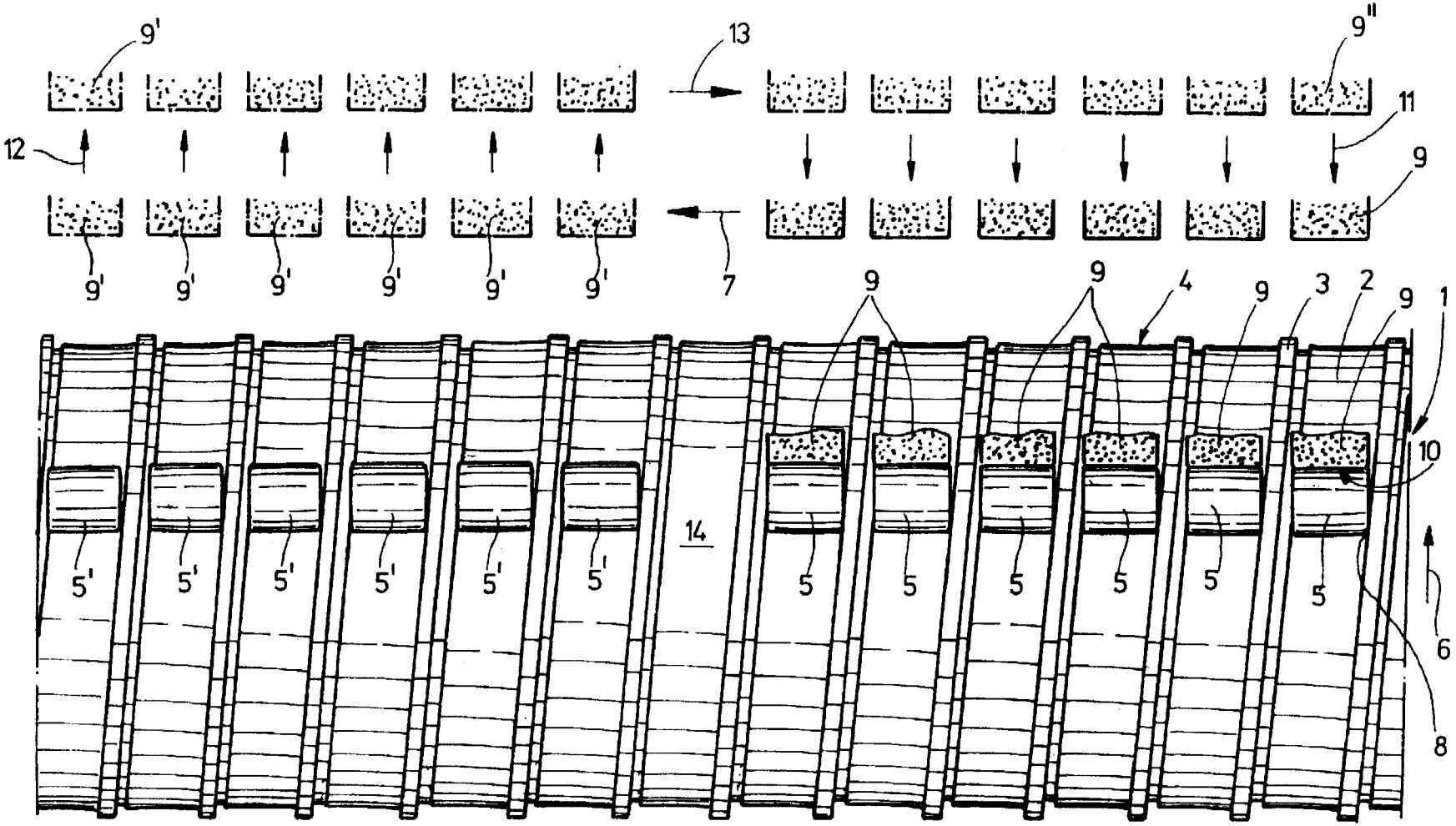
FIG. 1 shows a diagram of a schematic passage through the machine with a total of six rollers, which are finished to a final state by a one-step process.

FIG. 1 shows a side view of one of two transport rollers 1. This transport roller 1 has a transport worm 2 and a transport shoulder 3. The transport worm 2 runs in a spiral around the transport roller 1 and has a concave contact face 4. For each work cycle, six rollers 5 with barrel-shaped jacket faces rest upon this contact face 4, which rollers are supported on the transport roller 1 shown and on the transport roller provided next to that, which is not shown. The transport roller 1 rotates in the direction of the arrow 6, i.e. rotates clockwise, when viewed from above the right face end. This results in the fact that the rollers 5 likewise rotate, although in the opposite rotation direction, i.e. counterclockwise. In addition, the rollers are transported in the direction of the arrow 7. This is carried out by means of the transport shoulder 3, which contacts the face edge 8, which is disposed on the right side of the rollers 5.

It is also clearly visible from FIG. 1 that a honing stone 9 rests upon each of the rollers 5, which stone has a contact face 10, which is embodied corresponding to the jacket shape of the roller 5. This contact face 10 is consequently concave in the exemplary embodiment of the rollers 5, which is shown in FIG. 1.

Since the rollers 5 likewise rotate due to the rotating motion of the transport rollers 1, this leads to a relative motion with regard to the honing stones 9. The jacket faces of the rollers 5 are machined in this manner. In addition, the honing stones 9 carry out an oscillating motion, which essentially takes place in the direction of the axis of the rollers 5 or the transport rollers 1. If the rollers 5 have a cylindrical jacket face, then the oscillating motion takes place exactly parallel to the axis of the rollers. In the preceding case, the rollers 5 are embodied as barrel-shaped so that the honing stones 9 are supported in pendulum fashion and are swiveled around a pivot point, which is disposed, for example, above the rollers 5. The pendulum motion thus takes place along the curvature of the jacket face of each roller 5 in the longitudinal direction. Since the individual honing stones 9 are supported independent of each other and are disposed in pendulum fashion, each roller 5 is individually machined, independent from the others.

FIG. 1 shows a one-step process in which six honing stones 9 as a group are placed upon the six rollers 5 as a group in the direction of the arrows 11. This process of placing the honing stones 9 upon the rollers 5 is schematically represented above the transport rollers 1. If the honing stones 9 rest upon the rollers 5, then the honing stones 9 move together with the rollers 5 in the direction of the arrow 7, over a certain distance. During this time, the individual rollers 5 are machined, i.e. completely finished. After the passage through this distance, the honing stones 9' lift up from the completely finished rollers 5', which is schematically represented by the arrows 12. The honing stones 9' then rapidly return in the direction of the arrow 13 to their initial position, which is shown in FIG. 1 by means of the honing stone 9". The honing stones 9" are then disposed in a position in which they can be placed once again upon new rollers 5 to be machined, which takes place by lowering these honing stones 9" in the direction of the arrow 11. The machining process of these rollers 5 that follow takes place in exactly the same manner as the process just described.

A clearance 14 can be provided between the individual groups of rollers 5, for example by recessing one or more rollers. This clearance 14, though, is not absolutely required, so that there is also the possibility that the transport roller 1 is continuously stocked with rollers 5 to be machined. The machining path in this case is shorter than the length of the section on the transport roller 1, which section is stocked with rollers 5.

Figure 2:
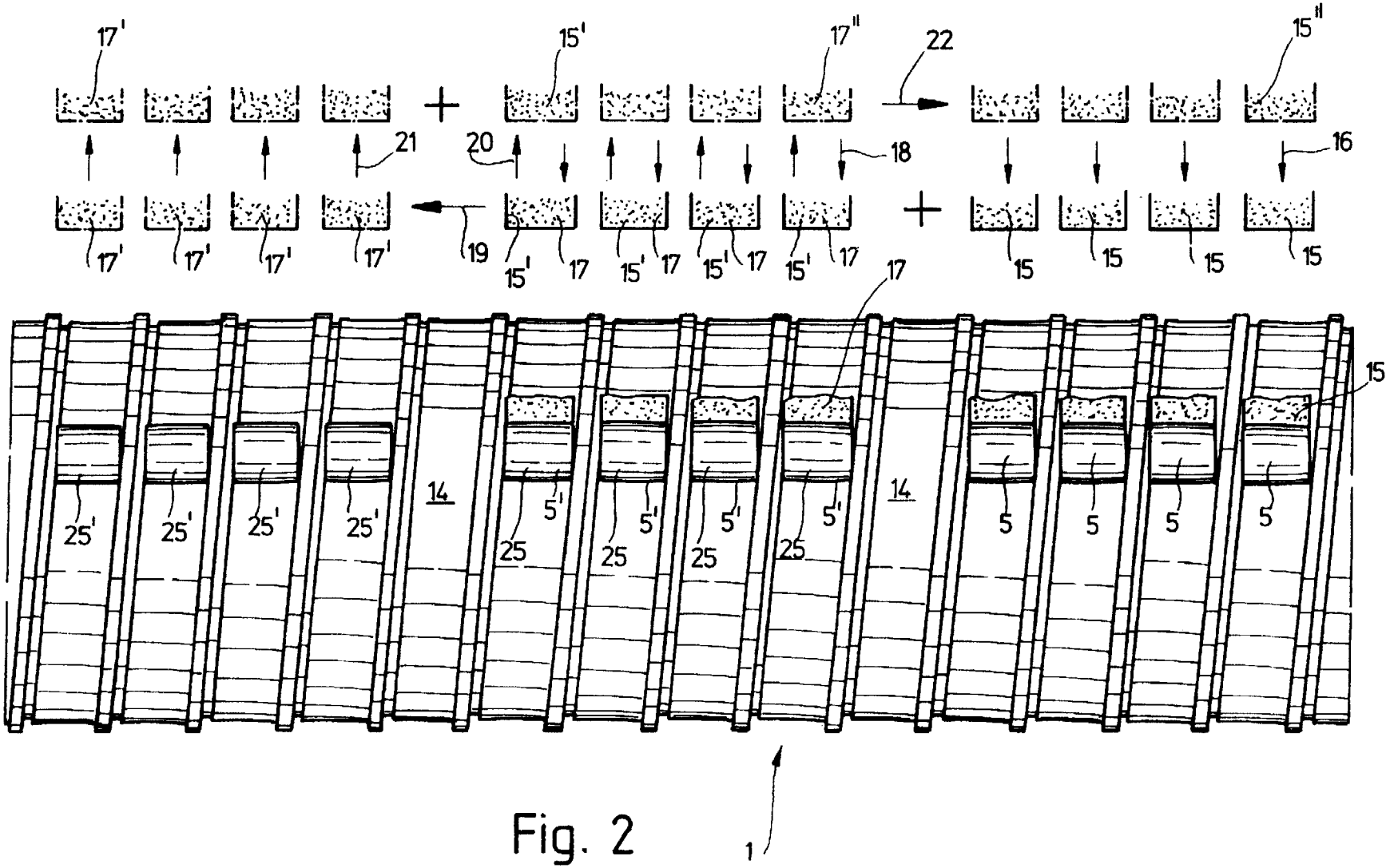
FIG. 2 shows a diagram of a schematic passage through the machine with a total of four rollers, which are pre-finished and finished to a final state by a two-step process.

FIG. 2 shows a second exemplary embodiment of the present invention in which the rollers 5 are machined in a two-step process. In the first machining step, honing stones 15 are placed onto the rollers 5 disposed beneath them, in the direction of the arrows 16. These honing stones 15 are pre-finishing stones and serve to pre-finish machine the rollers 5.

Simultaneously with the honing stones 15, honing stones 17 are placed upon a further group of four rollers 25, in the direction of the arrows 18. These honing stones 17 are final finishing stones and serve to completely machine the second group of rollers 25.

If the honing stones 15 and 17 are placed on both groups of rollers 5 and 25, then the honing stones 15 and 17 move together with the rollers 5 and 25 in the direction of the arrow 19. If the rollers 5 or 25 have reached a position, as indicated in FIG. 2 with the rollers 5' and 25', then both the pre-machining and the final machining of the rollers 5 or 25 is ended. The honing stones 15 and 17, which now assume the positions as indicated in FIG. 2 with stones 15' and 17', are now lifted up from the rollers 15' and 17' in the direction of the arrows 20 or 21. The honing stones 15' and 17' now return in the direction of the arrow 22, back to their initial position, which is indicated with honing stones 15" and 17". From this position, the honing stones 15" and 17" are lowered once again onto the rollers 5 and 25 in the direction of the arrows 16 and 18. Now the honing stones 17 meet the rollers 25, which were previously pre-machined as rollers 5, so that these rollers 25 now can be completely finished. The honing stones are placed one after the other upon each group of rollers 5, first the honing stones 15 for the pre-finishing and then the honing stones 17 for the final finishing. The completely finished rollers 25', that is, roller finished to a final state, are removed from the apparatus according to the present invention. In this second exemplary embodiment, clearances 14 are also provided between the individual groups, which spaces can be the size of one or more rollers. However, clearances 14 can also be omitted altogether.

FIGS. **3*a*–3*e* show the course of the process of the two-step process according to FIG. 2 and is subdivided into a plurality of stages a) through e) for a simpler explanation of the course. In the first stage, shown in FIG. 3*a*, the honing stones 15 and 17 are placed upon the rollers 5 and 25. The jacket faces of the rollers 5 are merely completely ground, but not pre-finished. The rollers 25 have already undergone the pre-finishing step and are therefore pre-machined. The rollers 5 and 25 are transported together with the honing stones 15 and 17 via the transport shoulder 3 in the direction of the arrow 19 by means of the rotation of the transport roller 1. This is hinted at in FIG. 3*b*, which shows the next stage. It can be seen here that new, completely-ground rollers 24 already follow the rollers 5. The completely finished rollers 25' are gradually removed from the transport roller 1. The transport of rollers 5 and 25 and honing stones 15 and 17 takes place synchronously once again in the direction of the arrow 19**.

In FIG. **3*c*, the next stage is shown, in which the rollers 5' and 25' are now pre-finished or completely finished and consequently have gone through the first or second process step. In this position, the honing stones 15' and 17'** have reached their left, ending position as well.

Now FIG. **3*d* schematically represents the transport of the honing stones from the left, ending position into the right, starting position. The honing stones 15' and 17', as shown in FIG. 3*c*, are lifted up from the rollers 5' or 25', in the direction of the arrows 20 and 21 so that these stones disengage from the rollers 5' or 25'. Then the honing stones 15' and 17' are rapidly returned in the direction of the arrow 22 to their initial position and are then ready as honing stones 15" and 17", to be placed once again upon new rollers to be machined. This placement takes place then in the direction of the arrows 16 and 18. During the lifting up, the rapid return, and the placement of the honing stones, the transport roller 1 moves further and the rollers are likewise transported over a small distance. This is illustrated by the two vertical lines 23 and 26**, from which the further transport of the individual rollers and honing stones can be estimated.

By and large, it can be determined that with this continuous process according to the present invention and with this apparatus according to the present invention, not only rollers 5 or 25 with cylindrical or conical jacket faces, but also rollers with a shape which diverges from the cylindrical, can be machined in the continuous process. The honing stones execute a motion that is reminiscent of the plunge-cutting process. However, the honing stones are moved as well, together with the rollers.

What is claimed is:

1. A process for the centerless superfinishing of rollers with arbitrary curved jacket faces, by means of associated honing stones of a machining apparatus, comprising the steps of:

engaging the curved jacket face of each roller with an associated honing stone;

oscillating each honing stone relative to its roller;

transporting the rollers and their associated honing stones together, while thereby rotating the rollers relative to their associated oscillating honing stone; and machining the rollers as a result of said engagement, oscillating and relative motions.

2. The process according to claim 1, comprising the steps of:

lifting the honing stone from its associated roller at the end of machining; and returning the honing stone to its initial position.

3. The process of claim 1, wherein each honing stone executes a pendulum motion during its oscillation in the machining of its associated roller.

4. The process according to claim 1, wherein the oscillation of each honing stone is in a direction parallel to the jacket face of its associated roller which is to be machined.

5. The process according to claim 1, wherein the jacket faces of the rollers are disposed symmetrically to the axis of oscillation of its perspective honing stone.

6. The process according to claim 1, wherein the jacket faces of the rollers are sloped with respect to the axes of oscillation of their respective honing stone.

7. The process according to claim 6, wherein the jacket faces of the rollers are sloped in the vertical plane.

8. The process according to claim 1, wherein a plurality of honing stones simultaneously engage a corresponding number of rollers in a work cycle.

9. The process according to claim 8, wherein up to twenty honing stones simultaneously engage a corresponding number of rollers in a work cycle.

10. The process according to claim 1, wherein a plurality of honing stones move together synchronously around at least one division of a transport roller used for transporting the rollers.

11. The process according to claim 10, wherein the plurality of honing stones move together synchronously around each division of the multiple divisions of the transport roller.

12. The process according to claim 1, wherein the rollers are machined in a one-step process.

13. The process according to claim 12, wherein the one-step process is carried out in synchronism with the passage of the rollers through the machining apparatus.

14. The process according to claim 1, wherein the rollers are machined in a multi-step process.

15. The process according to claim 14, wherein the multi-step process is carried out in synchronism with the passage of the rollers through the machining apparatus.

16. The process according to claim 14, wherein the multi-step process includes up to twenty steps.

17. The process according to claim 16, wherein the multi-step process is carried out in synchronism with the passage of the rollers through the machining apparatus.

18. An apparatus for superfinishing of rollers having an arbitrarily curved jacket face, comprising:

at least one honing stone associated with a roller to be machined;

means for oscillatingly driving the honing stone; and means for transporting the roller and its associated honing stone and rotating the roller while the roller is being machined by its associated honing stone which engages its curved jacket face.

19. The apparatus as defined in claim 18, wherein a plurality of honing stones and associated rollers are provided.

20. The apparatus as defined in claim 19, wherein said means for oscillatingly driving the honing stones provide a pendulum support for the honing stones.

21. The apparatus as defined in claim 19, wherein twenty honing stones and a corresponding number of rollers are provided.

22. The apparatus as defined in claim 18, wherein the infeed of the honing stone is carried out synchronously with the infeed of the roller.

23. The apparatus as defined in claim 18, wherein the infeed of the honing stone can be altered as a function of the infeed of the roller.

24. The apparatus as defined in claim 18, wherein the infeed of the honing stone can be altered during machining of the roller.

25. The apparatus as defined in claim 18, wherein the infeed of the roller can be altered during machining of the roller.

26. The apparatus as defined in claim 18, wherein the infeed of the honing stone and the infeed of the roller can be altered during machining of the roller.

27. The apparatus as defined in claim 18, wherein a plurality of honing stones and associated rollers are provided, each being disposed individually.

28. The apparatus as defined in claim 18, wherein a plurality of honing stones are provided having different specifications.

29. The apparatus as defined in claim 28, wherein the rollers are machined respectively by honing stones of different specifications.

30. The apparatus as defined in claim 28, wherein the honing stones having the same specifications are combined into groups.

31. The apparatus as defined in claim 30, wherein the rollers are machined respectively by honing stones of different groups.

32. The apparatus as defined in claim 19, wherein said means for transporting the rollers and their associated honing stones includes a plurality of transport rollers with at least one of said transport rollers including a transport worm whose shape corresponds to the jacket shape of the rollers.

33. The apparatus as defined in claim 32, wherein a transport shoulder adjoins the transport worm.

34. The apparatus as defined in claim 32, wherein the transport worm has multiple threads.

35. The apparatus as defined in claim 32, wherein the transport rollers are mutually aligned.

36. The apparatus as defined in claim 32, wherein the rollers rest on the transport rollers with linear contact.

37. The apparatus as defined in claim 32, wherein the rollers rest on the transport rollers with tangential contact.

38. The apparatus as defined in claim 32, wherein the rollers rest on the transport rollers with linear and tangential contact.

39. The apparatus as defined in claim 19, wherein each honing stone has a contact face which corresponds to the jacket shape of its associated roller.

40. The apparatus as defined in claim 18, wherein the honing stone has a rectangular shape.

41. The apparatus as defined in claim 18, wherein the honing stone has an H-shape.

42. The apparatus as defined in claim 18, wherein the honing stone has a square basic form.

43. The apparatus as defined in claim 19, wherein for each roller a separate receptacle is provided.

44. The apparatus as defined in claim 20, wherein for each honing stone separate means are provided for the pendulum motion.

45. The apparatus as defined in claim 20, wherein a separate receptacle is provided for each roller and separate means are provided for the pendulum motion of each honing stone.

* * * * *